United States Patent [19]

Ridley

[11] 4,414,729

[45] Nov. 15, 1983

[54] TOOL AND METHOD FOR CROWNING TEETH

[75] Inventor: Robert R. Ridley, Pontiac, Mich.

[73] Assignee: Ex-Cell-O Corporation, Troy, Mich.

[21] Appl. No.: 268,971

[22] Filed: Jun. 1, 1981

[51] Int. Cl.[3] ..... B21D 17/02; B21D 53/28; B23P 13/00; B23P 15/14

[52] U.S. Cl. ..... 29/159.2; 72/88; 72/469; 29/557; 76/107 R

[58] Field of Search ..... 72/469, 88, 90; 29/159.2, 557; 76/107 R

[56] References Cited

U.S. PATENT DOCUMENTS

| | | | |
|---|---|---|---|
| 440,330 | 11/1890 | Rogers | 72/469 |
| 446,934 | 2/1891 | Simonds | 29/159.2 |
| 2,197,732 | 4/1940 | Olson | 72/88 |
| 2,276,875 | 3/1942 | Richards | 72/469 |
| 3,115,052 | 12/1963 | McCardell | 72/88 |
| 3,602,026 | 8/1971 | De Caro et al. | 72/469 |
| 3,945,272 | 3/1976 | Simons | 72/88 |
| 4,208,773 | 6/1980 | Killop | 72/88 |

*Primary Examiner*—Daniel C. Crane

*Attorney, Agent, or Firm*—Edward J. Timmer; John C. Evans

[57] ABSTRACT

A tool and method for pressure forming teeth on the periphery of a cylindrical work piece wherein each of the teeth has a predetermined crown formed thereon. The tool includes a body having a leading edge and a trailing edge. The trailing edge of the tool body has an undercut surface thereon supportingly receiving a tooth crowning section having the side edges thereof shaped outwardly of the undercut surface on the tool to shape transversely formed insert teeth to form a predetermined crown on the teeth of the part being formed by the tool. In one method, preformed teeth on a rack insert are formed by a grinding tool following a straight path; the insert for forming the crown on the rolled part then is held on a grinding fixture base by a center shim so as to form a concave surface on the underside of the insert by exceeding the modulus of elasticity of the rack insert material wherein, following removal of the insert from the grinding fixture base, the teeth surfaces on the rack insert are shaped in a convex form to produce crowning of spline teeth on a cylindrical member that is pressure formed by the insert.

3 Claims, 9 Drawing Figures

TOOL AND METHOD FOR CROWNING TEETH

TECHNICAL FIELD

This invention relates to inserts for cold rolling racks and more particularly to inserts for cold rolling racks to form crowned teeth.

BACKGROUND ART

Heretofore many proposals have been suggested for cold forming spline teeth on a tool giving particular attention to the configuration of the rack teeth which form the tooth configuration on the part that is being cold formed. One example of such a proposal is set forth in U.S. Pat. No. 3,115,052 issued Dec. 24, 1963 to McCardell. In this arrangement, two opposed racks are aligned on either side of a part that is supported by means which permit it to rotate freely on a fixed axis as the racks are driven thereacross. Axially spaced teeth are formed transversely of the rack and are of a progressive depth so that as the racks are passed across the part, a plurality of teeth are formed along the length of the rolled part at circumferentially spaced points there around.

No metal is removed during the cold forming operation and the teeth that are formed on the rolled part are uncrowned.

In some applications, however, it is desirable to form teeth on the part that is being worked in a way that the teeth are crowned.

One arrangement for forming a plurality of teeth on a cold formed shaft is set forth in U.S. Pat. No. 4,208,773 issued June 24, 1980 to Killop. The '773 patent covers a single or split pair of racks that are located on either side of the tool holder at an angular relationship to the centerline of the part that will be formed thereby. Such an arrangement produces a single or double tapered spline which is not a true crown along the length of the spline tooth.

DISCLOSURE OF THE INVENTION

Accordingly, an object of the present invention is to provide a true crown along the length of teeth formed on a cold rolled cylindrical member and to do so by the provision of a tool insert having a plurality of preformed uniformly curved teeth therealong which are formed by shaping the tooth insert with respect to the tool to form a curvature from side to side of the insert throughout its length so that the tip surfaces and root surfaces of its teeth are curved in a manner to crown teeth on the part being rolled during deformation of the part.

Yet another object of the present invention is to provide an improved method for forming crown configurations on the teeth of a cold rolled cylindrical member by preforming a rack by grinding teeth thereon by a grinding tool moving in a straight path and thereafter locating the straight path formed teeth on the insert with respect to a trailing edge of a tool by means that will shape the tooth surfaces of the insert to have a concave shape from the end-to-end of the insert teeth whereby during movement of the tool with respect to a work piece freely rotated with respect thereto the insert teeth will form a crown on each of the teeth being formed on the cold rolled part.

Yet another object of the present invention is to provide an improved tool construction for pressure forming teeth on a freely rotated cold rolled part which reduces the cost of forming the working teeth of an insert to a shape which produces a crown on teeth formed on the cold rolled part and to do so by the provision of an insert having a plurality of pressure forming teeth formed along the length thereof by a grinding wheel which moves in a straight path and wherein the tool insert is adapted to be shimmed at its side edges so as to shape the working surfaces of teeth formed thereon into a concave configuration which will preshape the work piece during a pressure forming of teeth thereon to have a crown along the length of the formed teeth.

Yet another object of the present invention is to provide an improved tooth forming tool of the above type which is pre-formed elastically into a convex shape on one side thereof and fixedly secured to a grinding machine base to align a flat surface on the opposite face thereof with a wheel for grinding pressure forming teeth on the flat surface by movement of the wheel in a straight path and thereafter removing the tool from the fixture and returning the shaped convex surface thereon to a flat disposition while shaping the straight formed teeth on the opposite side thereof into a concave shape that will pressure form crowned teeth as the trailing edge of the pressure forming tool passes with respect to a freely supported cylindrical member being formed or cold worked by the tool.

Still another object of the present invention is to provide an improved tooth forming method of a type set forth above which eliminates the need for grinding variable depth tips on pressure forming teeth of a cold rolling tool by the provision of an improved method including the steps of forming a rack insert having a flat surface thereon which is ground to form a plurality of pressure forming teeth therealong by a wheel following a straight path and thereafter grinding the opposite surface of the insert to a concave shape to define integrally formed shim segments on opposite sides of the insert which will bear on the undercut trailing edge of a rack tool to be secured thereto by fastening means so as to cause the side edges of the straight formed teeth of a tool rack to be shaped in a concave fashion to form crown surfaces on teeth formed on a part cold rolled by use of the improved inserts.

The improved method for cold forming uniform curvature crowns on pressure formed teeth on a cold rolled part reduces the cost of grinding the pressure forming teeth on an insert at the trailing end of a spline forming rack. The method includes the steps of first locating the working surface of the insert and moving a grinding element in a straight path so as to form a pressure forming plurality of teeth on the working surface, each having a tip surface thereon that is formed at a constant depth; thereafter the working surface of the insert is deformed and the straight formed teeth thereon are shaped to have a curved surface at the tip of each of the teeth and a curved surface at the root of each of the teeth between the side edges of the insert. These teeth act on the cold formed cylindrical part to displace metal thereon to form a true, uniformly curved, crown on each of a plurality of circumferentially spaced teeth that are cold formed on the part worked by a rack tool including the improved insert.

The structure of the present invention, in one embodiment, includes a tooth forming rack having a leading end and a trailing end and wherein an undercut insert surface is formed on the trailing end with a flat surface configuration; an insert is supported on the cut-out surface. The insert has a supported surface and a working surface thereon and the working surface includes a plurality of pre-formed pressure forming teeth thereon, each preformed by a grinding wheel that follows a straight path with respect to the working surface. The insert is then shaped with respect to the flat surface of the tooth forming rack so that each of the pre-formed, straight ground teeth on the insert will be curved between the opposite edges of the insert so as to form a curved surface at the tip of each of the teeth and at the root of each of the teeth thereby to form a true crown on the tip and roots of pressure formed teeth on a cylindrical part that is cold rolled by the rack insert during a cold rolling operation.

BEST MODE OF CARRYING OUT THE INVENTION

Figure 1:
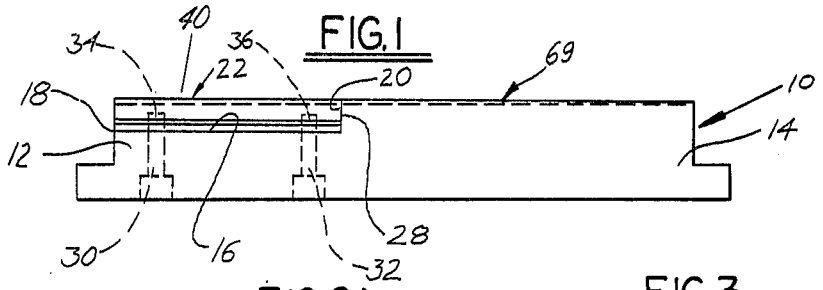
FIG. 1 is a side elevational view of a tooth forming rack including the crown forming insert of the present invention.

Referring now to FIG. 1, a tooth forming rack 10 is illustrated of a type set forth more particularly in U.S. Pat. No. 3,115,052 issued Dec. 24, 1963 to McCardell. In this patent two racks are formed on either side of a freely supported cylindrical part and they are moved with respect to one another to cause working teeth on each of the racks to form a plurality of circumferentially spaced teeth on the part that is being cold rolled. For purposes of understanding the present invention, description of the detail parts of the machine is not required. In order to clearly set forth the present invention such detailed components of the machine and their operation are omitted, with it being understood that reference can be had to U.S. Pat. No. 3,115,052 for a full understanding of the machine and its operation.

In accordance with the present invention, it is recognized that in order to form true crowns on pressure formed teeth during a cold rolling operation, it is necessary to form the pressure teeth on portions of the tooth forming rack by use of grinding tools that are moved through a continuously varying path during formation of the working teeth on the working face of the pressure applying rack insert.

In the present invention, however, a part of the tool 10 is especially shaped by methods that eliminate the need for such relatively expensive tooth formation. More particularly, the rack 10 includes a trailing end 12 and a leading end 14. The trailing end 12 includes an undercut insert support surface 16. The undercut surface 16 is a flat configured surface that extends from the trailing edge 18 of the tool 10 to an end abutment surface 20 that is vertically disposed with respect to the flat surface 16, as best seen in FIG. 1. The surface 16 supports a crowning section insert 22 which is configured in accordance with certain principles of the present invention to form a true crown on teeth of a cold rolled cylindrical member having teeth pressure formed thereon by use of the tool 10.

Figure 2:
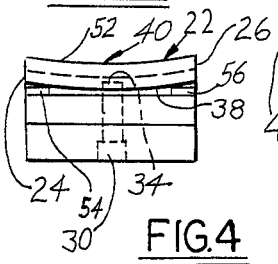
FIG. 2 is an end elevational view of the rack insert of FIG. 1.

More particularly, as shown in FIG. 1 and FIG. 2, the insert 22 includes spaced parallel sides 24, 26 and an end surface 28. The end surface 28 is in abutment with the surface 20 to locate the insert 22 lengthwise of the support surface 16. In the illustrated arrangement, the insert 22 is held to the trailing end 12 of the tool 10 by a pair of spaced screws 30, 32 that extend through the trailing end 12 of the tool 10 and into threaded engagement with tapped holes 34, 36 formed on the underside 38 of the insert 22.

Figure 2A:
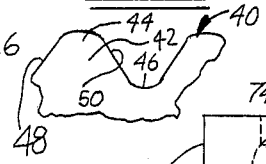
FIG. 2A is a fragmentary, side elevational view of the insert in FIG. 1.

In the working embodiment, the working surface 40 of the insert 22 has a plurality of longitudinally spaced teeth 42 that pressure form the teeth on a cylindrical part during a cold working operation. Each of the teeth 42, as shown in FIG. 2A, including a tip 44 and a root 46 which is joined to the leading and trailing flanks 48 and 50 on each of the teeth 42.

In one method, a blank insert is preformed to have flat, parallel surfaces. A plurality of straight teeth are formed on its working face by a grinding tool following a straight line path.

Each of the teeth 42 are pre-formed on the working surface by means of a grinding wheel which is operated in a straight line with respect to the insert to eliminate the need for complex control of the movement of the working tool during formation of the teeth. Accordingly, the economics of tooth formation correspond to those for forming uncrowned teeth on an insert for cold rolling a cylindrical work piece.

Figure 7:
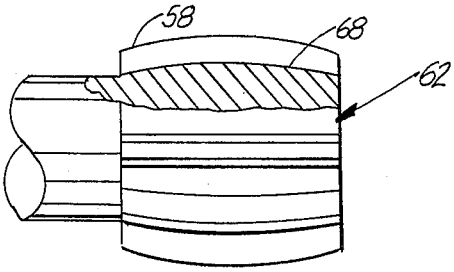
FIG. 7 is an elevational view, partially in section, of a cylindrical part formed with crowned teeth by use of the method of the present invention and use of the tool insert of the present invention.
Figure 8:
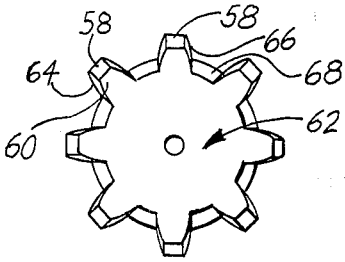
FIG. 8 is an end elevational view of FIG. 7.

Each of the straight formed teeth 42, in accordance with the present invention, are shaped to form a concave edge 52 on each tooth 42, as shown in FIG. 2. The formation of the concave edge 52 on each of the teeth is produced by the provision of a pair of spaced longitudinally directed shims 54, 56 that are wedged between the flat insert support surface 16 and the two sides 24, 26 of the insert 22, as shown in FIG. 2. The shims 54, 56 produce a desired end-to-end bending of the teeth 42 to produce the resultant concave edge 52 thereon at the tip 44. This configuration, during a cold rolling operation utilizing the tool 10, will produce a true crowned tip 58 on a resultant cold formed tooth 60 that is formed on a cylindrical part 62 which is rolled by use of the tooth forming rack 10. The true crown, as shown in FIGS. 7 and 8, is a constant curvature surface along the length of each tooth 60. Each tooth 60 has flanks 64, 66 and crowned root segment 68 thereon shaped by use of a working surface 69 that is formed on the tool 10 to produce a final tooth shape prior to the crown formation by the insert 22. The tooth configuration on the insert 22 will produce the crowning action and the tooth configuration on the remaining surface 69 of the tool 10 will establish the desired further characteristic of the teeth 60 on the part being rolled.

Figure 3:
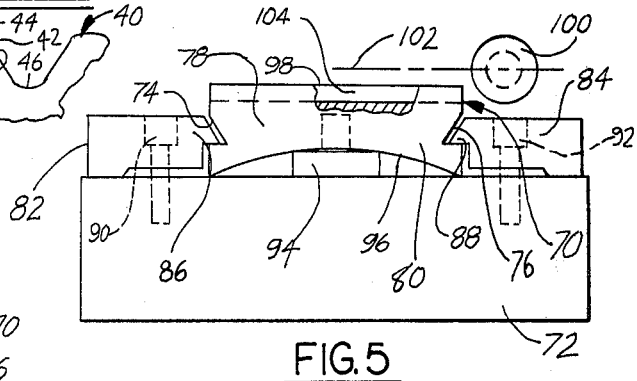
FIG. 3 is an end elevational view showing a rack insert in a supported relationship on a grinding rack grinder having a center shim elastically deforming inboard material of the insert and having a grinding wheel located to move in a straight path with respect to the insert to form tooth deforming teeth on its working surface.

The method of the present invention, can be accomplished in one working embodiment by placing an insert blank 70 on a grinding fixture base 72 and providing notches 74, 76 on each side 78, 80 of the insert blank 70 for connection to hold-down rails 82, 84. The hold-down rails 82, 84 include side edges 86, 88 that fit within the notches 74, 76. Hold-down screws 90, 92 secure the rails 82, 84 against the sides 78, 80 of the insert 70 to hold it with respect to a shim 94 that is located at the center of the underside 96 of the insert blank 70. The shim has a depth to produce a concave, elastic deformation of the underside 96 as shown in FIG. 3 when the hold-down rails 82, 84 are clamped in place. A flat upper surface 96 is held on the insert 70. The upper surface 98 is then machined by a suitable grinding tool 100 to form longitudinally spaced pressure forming teeth on the insert 70. The grinding tool 100 is operated on a straight line 102 and is not moved along a curved path to produce a tooth configuration for crowning operation.

Figure 4:
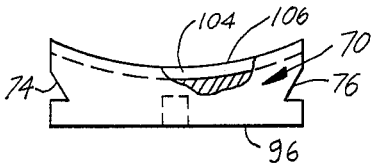
FIG. 4 is a tool formed on the fixture of FIG. 3 following removal of a center shim to produce a resultant concave configuration on the pressure forming teeth on the working surface of the insert.

Following the formation of the straight teeth on the upper surface 98, one tooth 104 being shown in FIG. 3, the insert 70 is removed from the grinding fixture base 72. Since the machined insert 70 is elastically shaped at the inner surface 96, when the part is released from the fixture 72, surface 96 will return to a flat position, as shown in FIG. 4. A resultant shaping of the upper surface 98 of the insert 70 occurs wherein each of the straight formed teeth 104 thereon have a curved edge 106 formed thereon.

Figure 5:
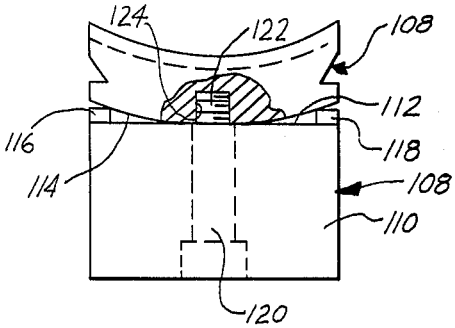
FIG. 5 is a view showing the tool insert of FIG. 4 shimmed into another embodiment of a crown forming tooth configuration.

For purposes of understanding the present invention, the amount of crowning that is obtained by the shaped teeth of the tools, whether by use of shims as in the embodiment of FIGS. 1 and 2, or by the use of a pre-curving of an insert 70 during formation of the straight teeth thereon, will be in the order of one to two thousandths of an inch. In order to demonstrate the fact of curvature of each of the teeth, because of shaping of the insert block, the amount of curvature of the concave edges 52 in the embodiment of FIGS. 1 and 2 are somewhat exaggerated as is the curvature of the edge 106. The inside surface of the insert 70 has a certain amount of convex shape retained therein and this can be increased by shimming as in the case of the FIGS. 1 and 2 embodiment of the invention. The use of insert 70 with further shaping of the curved edges 106 on the teeth and insert working surfaces is shown in FIG. 5 wherein a tool 108 has its trailing end 110 undercut at 112 to support a convexly shaped surface 114 of the tool 70. Surface 114 is shaped by use of side shims 116, 118 held against the underside of the insert 70 by suitable pressure imposing fasteners such as a plurality of spaced screws 120, one of which is shown in FIG. 5. Each screw 120 has a threaded end 122 thereon threadably received within a tapped opening 124 on the insert 70.

Figure 6:
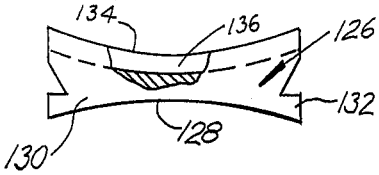
FIG. 6 is an end elevational view of a further embodiment of a tool insert including the present invention.

In the embodiment of FIG. 6 a crowning rack insert 126 is shown having an under surface 128 thereon preground to a concave shape. In this embodiment the resultant insert has a pair of integrally formed shims 130, 132 thereon which, when held against a flat insert support surface of a tool as shown in FIG. 1, will produce a crown curvature on the insert to result in a plurality of end-to-end concave surfaces 134 on each of previously straight formed teeth 136 on the insert formed by use of a wheel that is moved in a straight line with respect to the working surfaces during a tooth grinding operation of the type set forth in FIG. 3.

INDUSTRIAL APPLICABILITY

It is apparent from the foregoing that the present invention, providing an improved tool and method for forming low cost ground teeth on a tool insert for use in a tooth forming rack for pressure forming teeth on a cylindrical part during a cold rolling operation. The low cost straight ground teeth are deformed by shaping the insert to have an end-to-end curvature that will result in a true crown on teeth formed on the cylindrical work piece by use of the improved tool. The curvature will produce a true crown both on the tip and at the root of the part being formed by the insert.

What is claimed is:

1. A tool for pressure forming teeth on a cold rolled cylindrical member comprising a tooth forming rack having a tooth forming working surface having a leading edge and a trailing edge, said tooth forming rack including an undercut surface on the trailing end thereof having an insert supporting surface extending in spaced apart non-intersecting relation with the tooth forming working surface, an insert supported on said undercut surface including side edges thereon with an insert working surface therebetween and having a plurality of pre-formed teeth extending in length toward the side edges on the working surface of the insert each having pre-formed straight ground tips, and means on said insert for deforming the pre-formed teeth on the working surface of the insert into a concave shape for producing a continuous concave curvature along the length of the teeth of the insert from one of said side edges to the other including intermediate insert portions therebetween such that said deforming means exerts a force on the insert in a transverse plane substantially normal to said undercut surface so that as the leading edge of the rack passes with respect to a part to be cold rolled by the tool the concave curvature of the teeth will form a predetermined true curvature crown on each tooth rolled on the cold rolled part.

2. An improved tool for cold rolling external teeth on cylindrical members comprising a tooth forming rack having a tooth forming working surface and having a leading end and a trailing end, an undercut surface formed on the trailing end and having an insert supporting surface extending in spaced non-intersecting relation with the tooth forming working surface, an insert member supported on said undercut surface including opposite side portions thereon and having a working surface extending from the side edges and extending through the length of the insert member, a plurality of pre-formed teeth extending in length between the side portions at spaced points along the length of said working surface, each of said teeth having a pre-formed straight-ground tip and root, shim means on said undercut surface engaging opposite said side portions of said insert in a manner that said insert member bridges said shim means, and means intermediate said shim means for deforming in cooperation with said shim means the insert working surface thereof with respect to the undercut surface at the trailing end to form a continuous crown curvature along the length of each of the straight formed teeth thereon between the side portions thereof such that said deforming means exerts force on the insert in a transverse plane substantially normal to said undercut surface whereby the insert member will form a resultant continuously curved, true crown along the length of each of the teeth formed on the cold rolled part.

3. An improved method for cold forming transversely directed uniform cross-section teeth along the length of a cylindrical part with a tooth forming rack including the steps of pre-forming an insert to have a flat working surface thereon, grinding pressure forming teeth across the working surface by a grinding wheel following a straight line with respect to the depth of the working surface of the insert, providing the trailing end of a tooth forming rack having a tooth forming working surface with an undercut support surface extending in spaced apart non-intersecting relation with the tooth forming working surface, locating the insert at said trailing end of the tooth forming rack on said undercut support surface thereof and shaping the working surface of the insert by exerting a force on said insert in a direction substantially normal to the undercut support surface to cause the teeth to have a uniform concave curvature transversely along the length of the teeth thereof from one side to the opposite side of the insert and intermediate insert portions therebetween and moving the rack insert relative to the outer surface of a cylindrical cold rolled part with the axis of the part substantially parallel with the length of the teeth to produce a resultant uniformly crowned tooth on the cold rolled part along the length of each pressure formed tooth formed by the working teeth of the insert.

* * * * *